US011317687B2

(12) United States Patent
Clarke

(10) Patent No.: US 11,317,687 B2
(45) Date of Patent: May 3, 2022

(54) ELECTRONIC UMBRELLA

(71) Applicant: Tia Clarke, Brooklyn, NY (US)

(72) Inventor: Tia Clarke, Brooklyn, NY (US)

( * ) Notice: Subject to any disclaimer, the term of this patent is extended or adjusted under 35 U.S.C. 154(b) by 0 days.

(21) Appl. No.: 17/166,042

(22) Filed: Feb. 3, 2021

(65) Prior Publication Data

US 2021/0235827 A1 Aug. 5, 2021

Related U.S. Application Data

(60) Provisional application No. 62/969,481, filed on Feb. 3, 2020.

(51) Int. Cl.

| | |
|---|---|
| ***A45B 19/00*** | (2006.01) |
| ***A45B 23/00*** | (2006.01) |
| ***A45B 11/00*** | (2006.01) |
| ***A45B 25/00*** | (2006.01) |

(52) U.S. Cl.

CPC ..... *A45B 19/00* (2013.01); *A45B 11/00* (2013.01); *A45B 23/00* (2013.01); *A45B 25/00* (2013.01); *A45B 2023/0068* (2013.01)

(58) Field of Classification Search

CPC ..... A45B 23/00; A45B 25/24; A45B 19/00; A45B 2023/0068; A45B 11/00

See application file for complete search history.

(56) References Cited

U.S. PATENT DOCUMENTS

| | | | | |
|---|---|---|---|---|
| 821,822 | A * | 5/1906 | Nootbaar | G09F 17/00 248/516 |
| 4,193,415 | A * | 3/1980 | Hermanson | A45B 19/00 135/25.2 |
| 4,543,971 | A * | 10/1985 | Sirota | A45B 11/00 135/16 |
| 5,529,368 | A * | 6/1996 | Cui | A45B 11/00 135/16 |
| 6,213,137 | B1 * | 4/2001 | Wang | B60R 7/12 135/16 |
| 7,069,939 | B1 * | 7/2006 | Conde | A45B 25/00 135/16 |
| 7,493,908 | B2 | 2/2009 | Carter et al. | |
| 8,439,055 | B2 | 5/2013 | April et al. | |
| 2004/0099295 | A1 | 5/2004 | You | |
| 2006/0283489 | A1 * | 12/2006 | Ho | A45B 11/02 135/20.1 |
| 2008/0190469 | A1 | 8/2008 | Amsel | |
| 2019/0059531 | A1 | 2/2019 | Patin | |
| 2020/0329835 | A1 * | 10/2020 | Ferrara | A45B 11/00 |

* cited by examiner

*Primary Examiner* — Noah Chandler Hawk

(74) *Attorney, Agent, or Firm* — Boudwin Intellectual Property; Daniel Boudwin

(57) ABSTRACT

An electronic umbrella is provided. The device includes a housing having a fastener disposed on a lower surface thereof. A motor is disposed within the housing, wherein the motor is operably connected to a power source disposed within the housing. A rod is affixed to an upper surface of the housing. An extendable arm is affixed to the rod, wherein the extendable arm is operably connected to the motor. Upon actuation of the motor, the extendable arm moves between an extended position and a retracted position. The device further includes an umbrella assembly having a central support, a plurality of ribs extending from the central support, and a canopy affixed over the plurality of ribs. The central support is pivotally affixed to a distal end of the extendable arm.

20 Claims, 6 Drawing Sheets

ELECTRONIC UMBRELLA

CROSS REFERENCE TO RELATED APPLICATIONS

This application claims the benefit of U.S. Provisional Application No. 62/969,481 filed on Feb. 3, 2020. The above identified patent application is herein incorporated by reference in its entirety to provide continuity of disclosure.

BACKGROUND OF THE INVENTION

The present invention relates to electronic umbrellas. More particularly, the present invention pertains to a hands-free umbrella securable to a stroller, wheelchair, or other device to extend and cover the user.

Many individuals rely on umbrellas to protect themselves from harsh sunlight or inclement weather when outside. However, traditional umbrellas have several shortcomings, such as the requirement that the user manually support the umbrella, leaving one hand constantly occupied when the umbrella is in use. This can make it difficult to perform everyday activities that require the use of two hands. For example, individuals may struggle to simultaneously push a stroller, carry luggage, bags, or purses, hold a leash, or the like while also maintaining an umbrella upright at a desired angle. Similarly, attaching an open umbrella to a support, such as a handle of a stroller, wheelchair, or the like lacks the desired adjustability to position the umbrella canopy over the user easily. Therefore, a device that can attach an umbrella to a support surface, while readily allowing the user to extend and adjust the position of the umbrella with minimal effort is desired.

In light of the devices disclosed in the known art, it is submitted that the present invention substantially diverges in design elements from the known art and consequently it is clear that there is a need in the art for an improvement to existing electronic umbrella. In this regard, the instant invention substantially fulfills these needs.

SUMMARY OF THE INVENTION

In view of the foregoing disadvantages inherent in the known types of electronic umbrellas now present in the known art, the present invention provides an electronic umbrella wherein the same can be utilized for providing convenience for the user when protecting the user from sun and rain while pushing a stroller, wheelchair, shopping cart, or other device.

The present system comprises a housing having a fastener disposed on a lower surface thereof. A motor is disposed within the housing, wherein the motor is operably connected to a power source disposed within the housing. A rod extends from an upper surface of the housing. In some embodiments, the rod is hingedly affixed to the upper surface, such that the rod can be collapsed to rest flush against the upper surface. An extendable arm is affixed to the rod, wherein the extendable arm is operably connected to the motor. Upon actuation of the motor, the extendable arm selectively moves between an extended position and a retracted position. An umbrella assembly comprises a central support, a plurality of ribs extending from the central support, and a canopy affixed over the plurality of ribs. The central support is pivotally affixed to a distal end of the extendable arm.

In some embodiments, a pair of controls are disposed on the housing, wherein a first control of the pair of controls actuates the motor to extend the extendable arm, and a second control of the pair of controls actuates the motor to retract the extendable arm. In another embodiment, the rod is rotatably affixed to the upper surface. In other embodiments, the extendable arm comprises a plurality of hingedly connected segments. In yet another embodiment, the extendable arm comprises a scissor arm. In some such embodiments, the scissor arm comprises a first arm member having a first plurality of hingedly connected segments disposed opposite a second arm member having a second plurality of hingedly connected segments. In another embodiment, the fastener comprises a clamp defining a cylindrical channel between a pair of clamp members. In other embodiments, the central support is pivotally affixed to the distal end via a ball and socket joint. In yet another embodiment, the rod is telescopically adjustable in length.

BRIEF DESCRIPTION OF THE DRAWINGS

Although the characteristic features of this invention will be particular pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
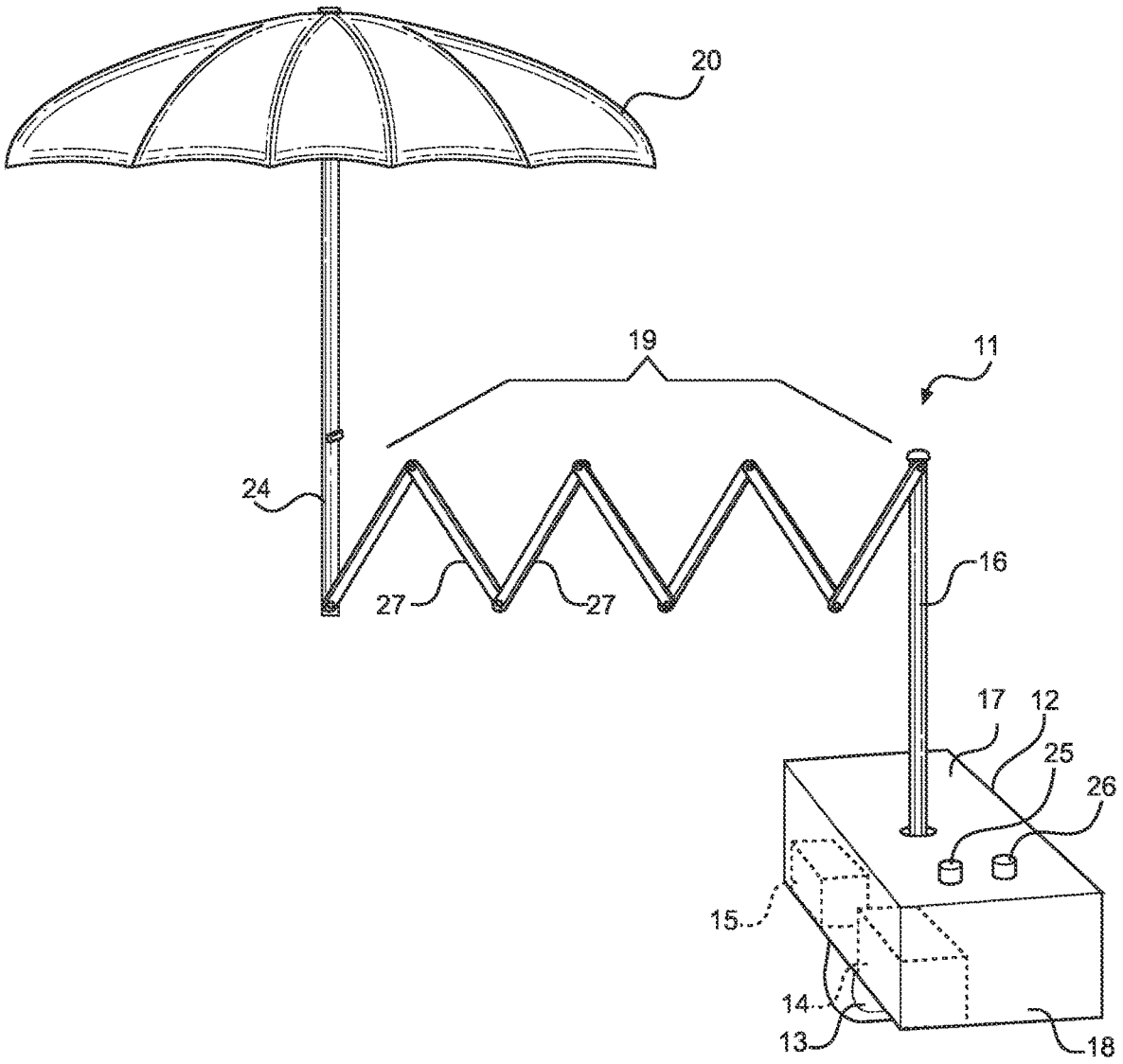
FIG. 1A shows a perspective view of an embodiment of the electronic umbrella.

Reference is made herein to the attached drawings. Like reference numerals are used throughout the drawings to depict like or similar elements of the electronic umbrella. The figures are intended for representative purposes only and should not be considered to be limiting in any respect.

Figure 1B:
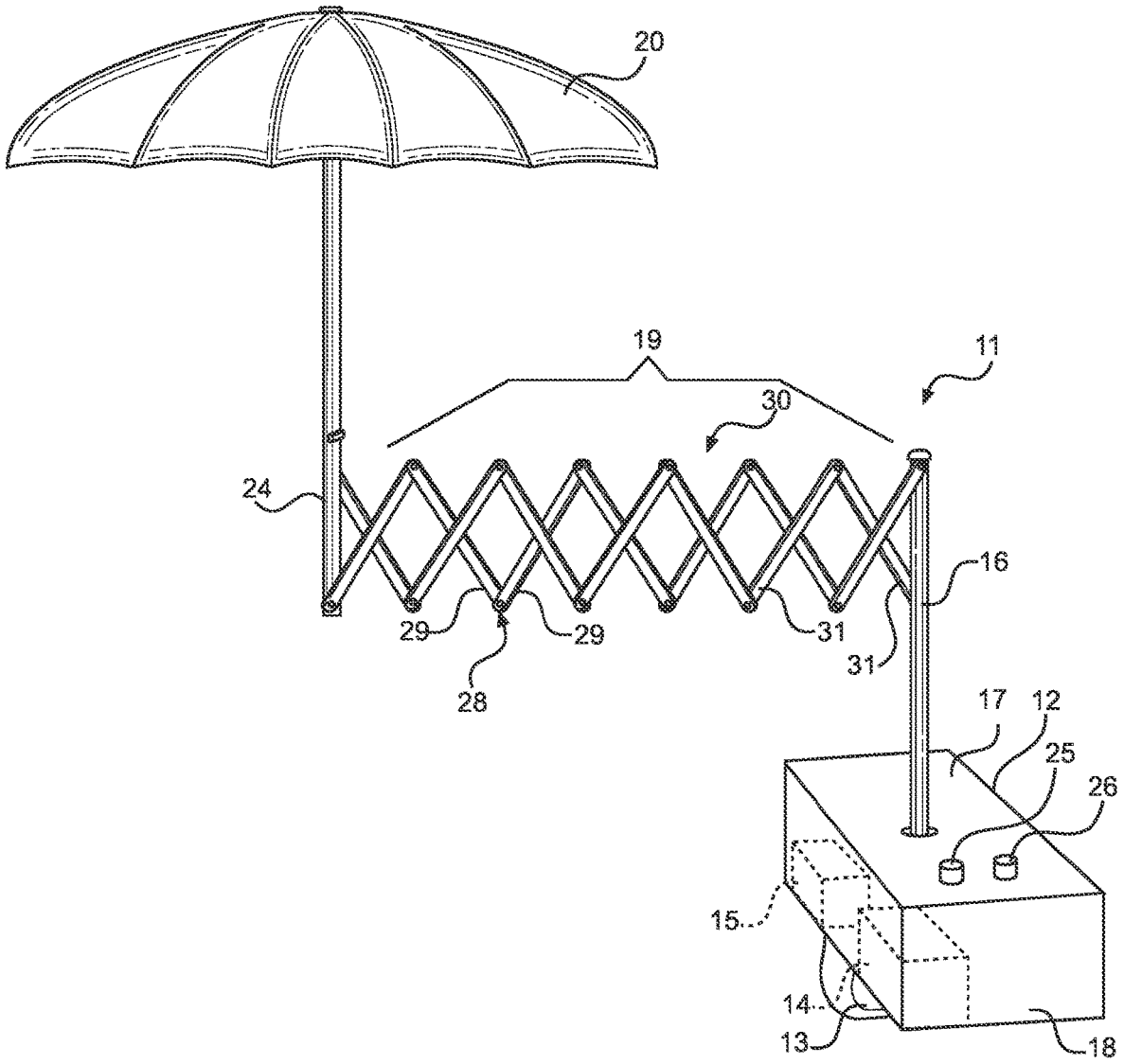
FIG. 1B shows a perspective view of an alternate embodiment of the electronic umbrella.
Figure 4:
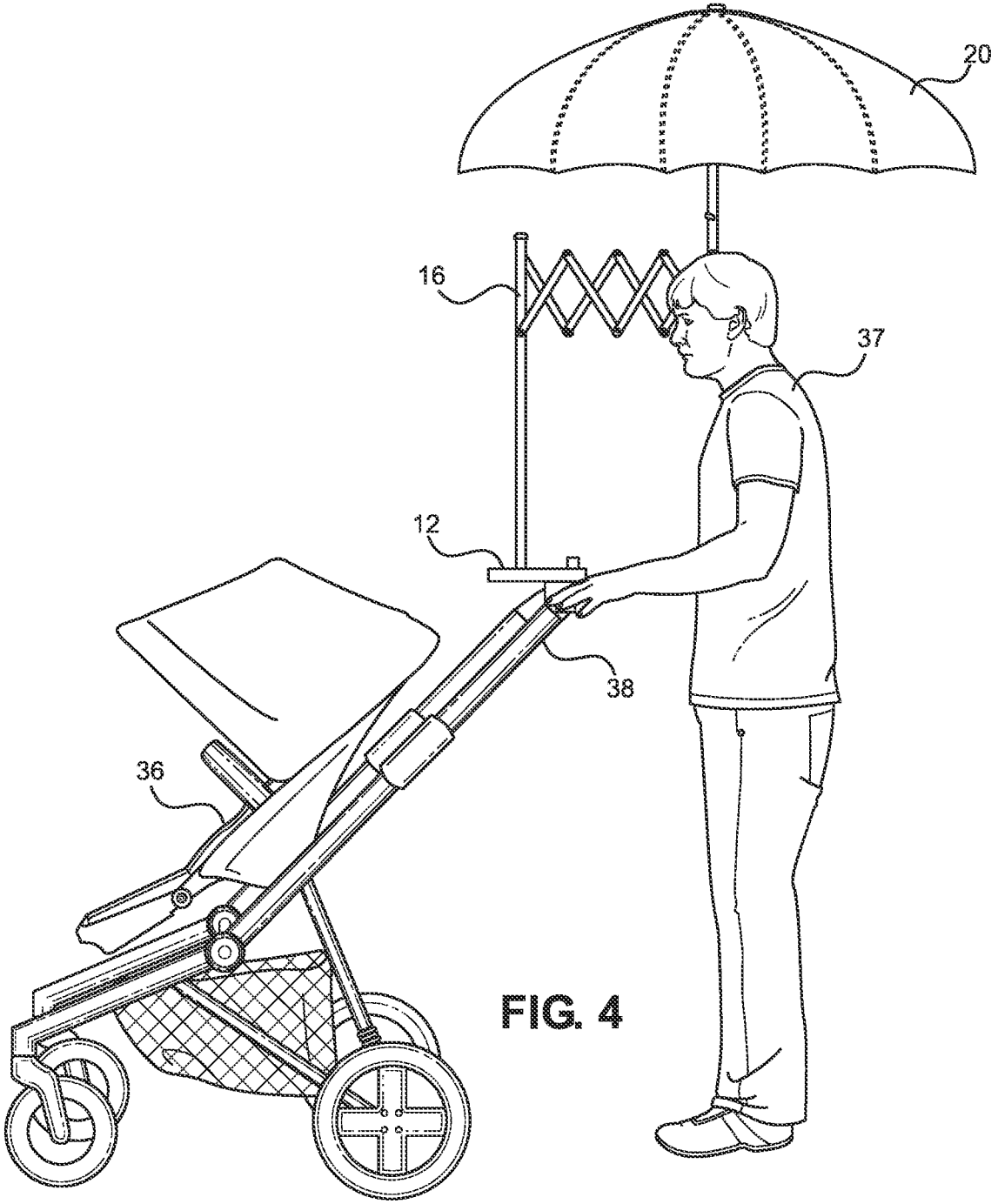
FIG. 4 shows a perspective view of an embodiment of the electronic umbrella in use.

Referring now to FIGS. 1A and 1B, there are shown perspective views of various embodiments of the electronic umbrella. The electronic hands-free umbrella 11 comprises a housing 12 having a fastener 13 disposed on a lower surface 18 thereof. The fastener 13 is configured to removably secure the housing 12 to a separate support arm, such as the handle (as shown in FIG. 4, 38) or grip of a stroller, wheelchair, or the like. The housing 12 further comprises a motor 14 within an interior volume of the housing 12, wherein the motor 14 is operably connected to a power source 15. The power source 15 can comprise a battery, or in some alternate embodiments, a direct connection to an external power source 15. In the shown embodiment, the housing 12 comprises a rectangular form factor, however, in alternate embodiments, the housing 12 comprises alternate shapes suitable for a user's aesthetic preferences.

A rod 16 extends from an upper surface 17 of the housing 12, wherein an extendable arm 19 is affixed to the rod 16. The extendable arm 19 is operably connected to the motor 14, such that when the motor 14 is actuated, the extendable arm 19 selectively moves between an extended position and a retracted position. In the illustrated embodiment, a plurality of controls is disposed on the housing 12, wherein the plurality of controls includes a first control 25 and a second control 26. The first and second controls 25, 26 are configured to actuate the motor to selectively move the extendable arm 19 between an extended position and a retracted position, respectively. An umbrella assembly 20 is affixed to a distal end 24 of the extendable arm 19, wherein the umbrella assembly 20 can be selectively positioned to cover a user while the user's hands are otherwise occupied. In this manner, the user can easily position the extendable arm 19, and therefore, the umbrella assembly 20, at various degrees of extension, such that the umbrella assembly 20 is placed in a desired position. In some embodiments, the rod 16 is rotatably affixed to the housing 12, such that the extendable arm 19 can be selectively repositioned via rotation of the rod 16 about a longitudinal axis thereof.

The extendable arm 19 of FIG. 1A comprises a plurality of hingedly connected segments 27, wherein the plurality of hingedly connected segments 27 expand and retract about hinges therebetween, such that the extendable arm 19 can move between the extended and retracted position. In the shown embodiment of FIG. 1B, the extendable arm 19 comprises a scissor arm having a first arm member 28 comprising a first plurality of hingedly connected segments 29 disposed opposite a second arm member 30 comprising a second plurality of hingedly connected segments 31. When the scissor arm of Fla 1B is extended, the first and second pluralities of hingedly connected segments 29, 31 move from a position substantially parallel to the rod 16 to an angled position, thereby providing additional structural support to the distal end 24 than found in the embodiment of FIG. 1A.

Figure 2:
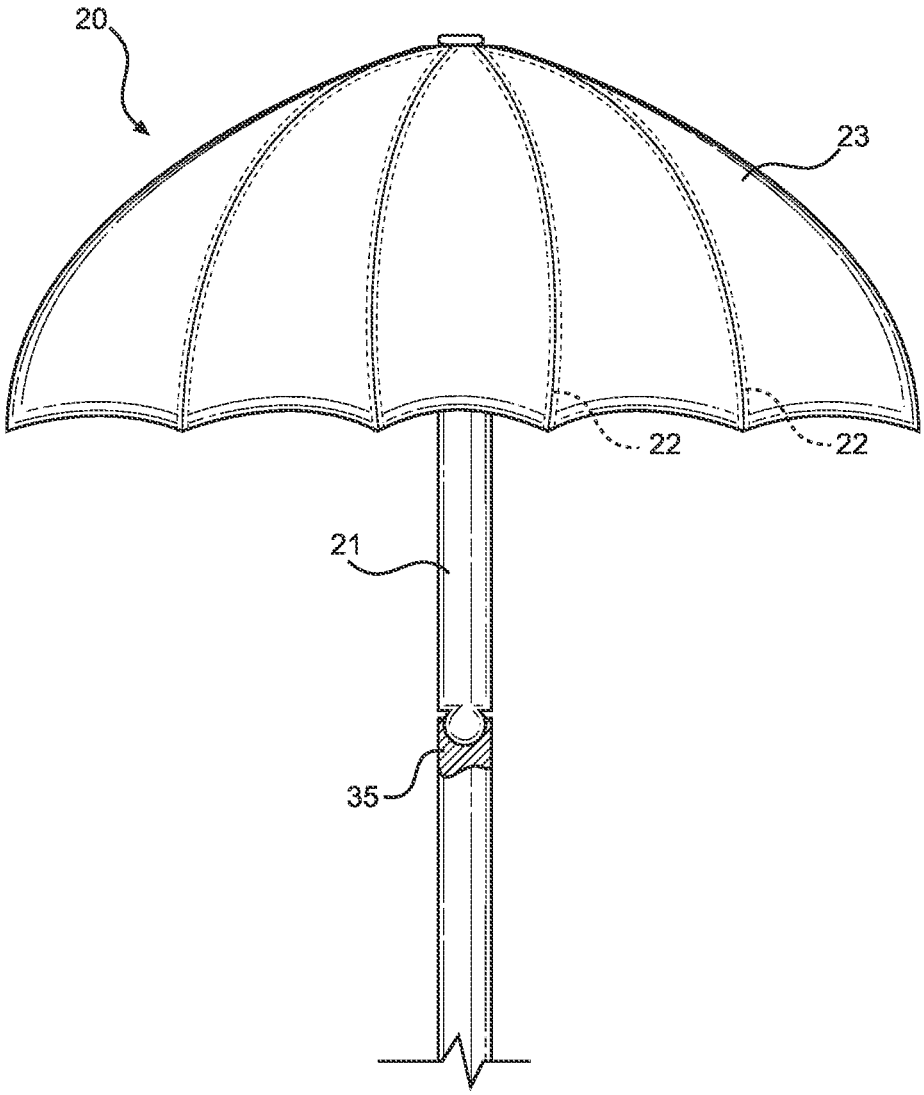
FIG. 2 shows a close-up view of the umbrella assembly of an embodiment of the electronic umbrella.

Referring now to FIG. 2, there is shown a close-up view of the umbrella assembly of an embodiment of the electronic umbrella. The umbrella assembly 20 comprises a central support 21 having a plurality of ribs 22 extending therefrom, wherein the plurality of ribs 22 are movable between an open position and a closed position, such that the umbrella assembly 20 can be selectively opened. A canopy 23 is affixed over the plurality of ribs 22. In the illustrated embodiment, the central support 21 is pivotally affixed to the distal end of the extendable arm via a ball and socket joint 35. In this manner, the umbrella assembly 20 can be angled relative to the distal end to allow the user to adjust the angle of the umbrella canopy 23 to ensure the user or is properly protected from sun, precipitation, or other undesired conditions. In other embodiments, the central support 21 is pivotally affixed via alternate means, such as a hinge, however, the range of motion provided by the ball and socket joint 35 as shown is particularly advantageous for mobile applications, such as when a user is pushing a wheelchair, stroller, or the like. In such situations, the movements of the user may require the user to reposition the umbrella assembly 20 along a wide area to provide continued protections.

Figure 3A:
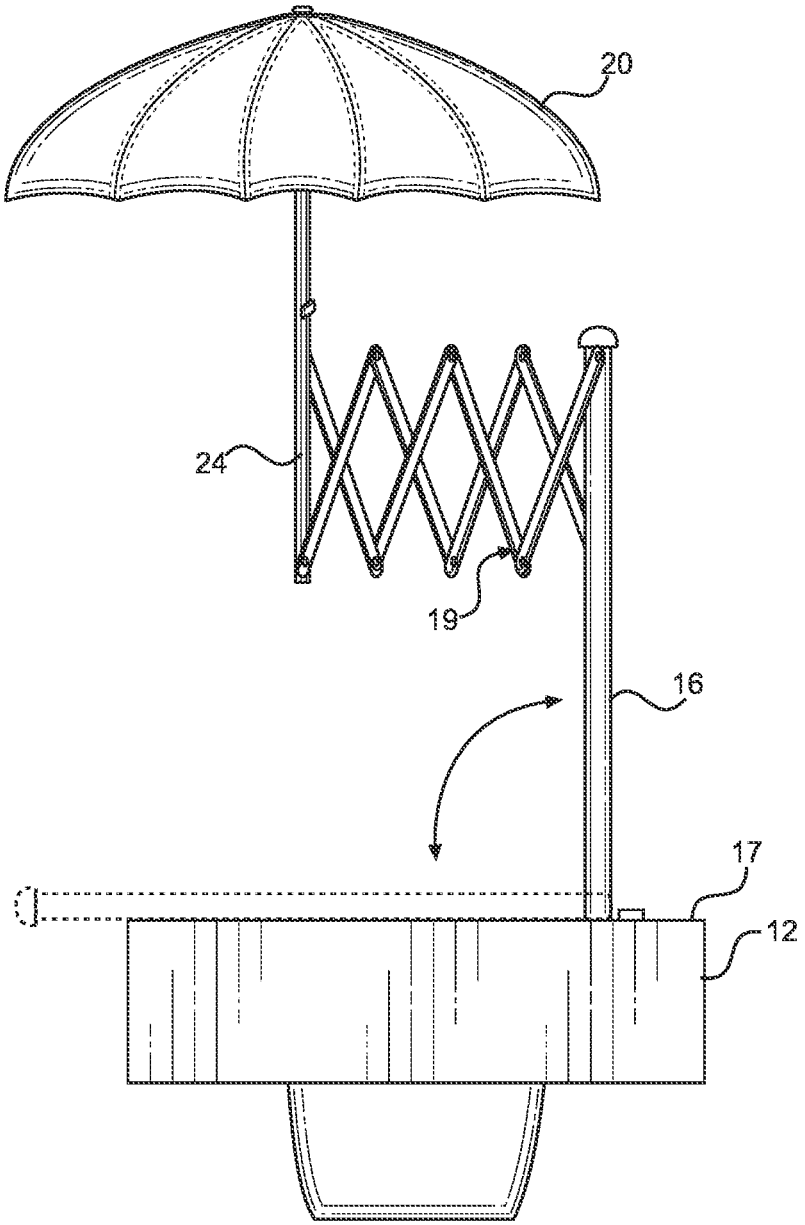
FIG. 3A shows a side view of the rod an embodiment of the electronic umbrella.
Figure 3B:
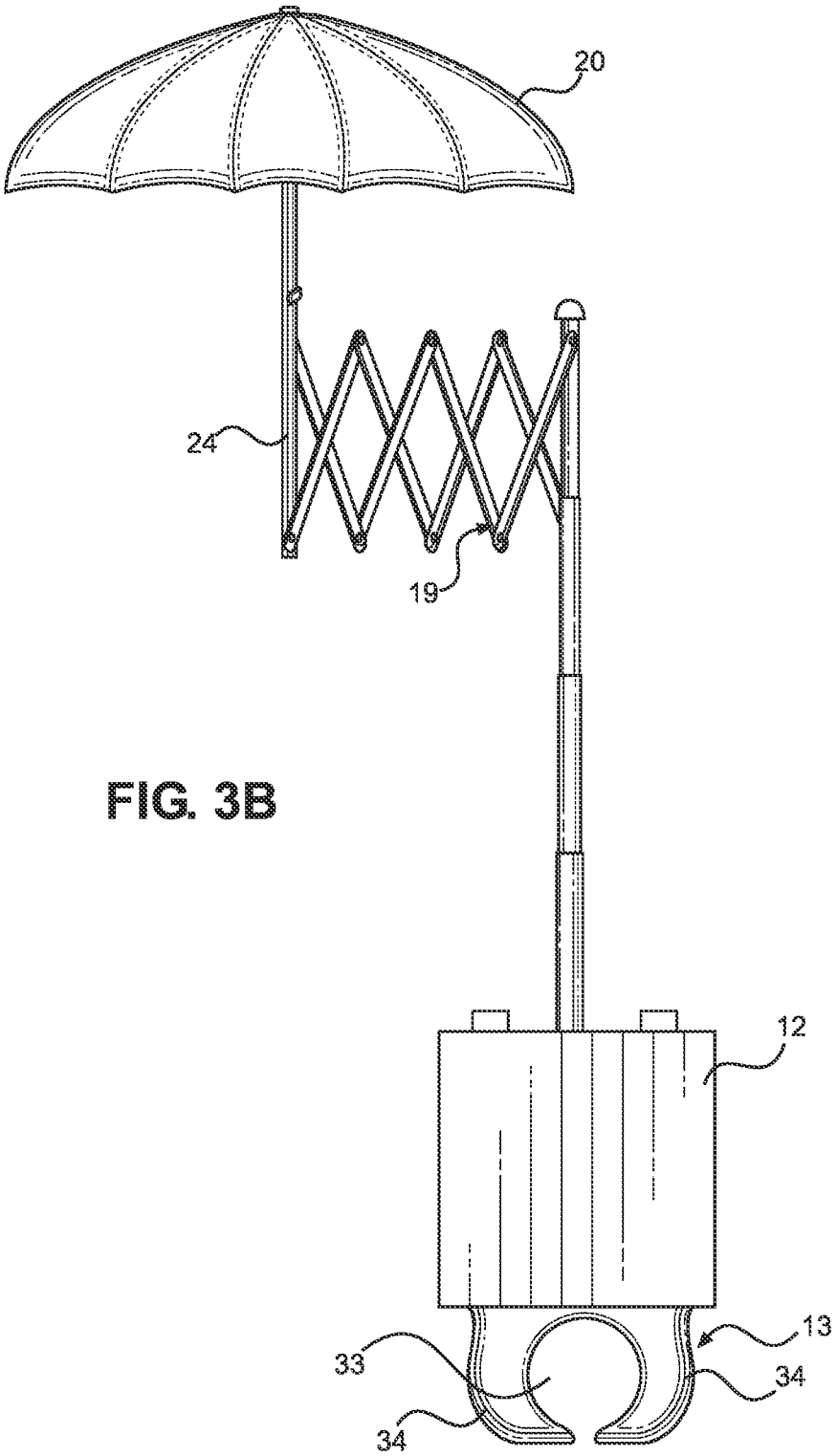
FIG. 3B shows a front view of the rod of an alternate embodiment of the electronic umbrella.

Referring now to FIGS. 3A and 3B, there is shown a side view of the rod an embodiment of the electronic umbrella and a front view of the rod of an alternate embodiment of the electronic umbrella, respectively. In the illustrated embodiments, the extendable arm 19 is shown in a partially retracted position. In a fully retracted position, the distal end 24 is contemplated to rest substantially flush against the rod 16 to minimize the form factor of the device in a collapsed position. In the shown embodiment, the distal end 24 is parallel to the rod 16 in each of the extended and retracted positions, as well as any position therebetween. In this manner, the umbrella assembly 20 affixed to the distal end 24 is initially positioned parallel to the rod 16, ensuring that the umbrella assembly 20 is positioned properly for a majority of use cases. In the illustrated embodiment of FIG. 3A, the rod 16 is hingedly affixed to the upper surface 17 of the housing 12, wherein the rod 16 can be folded when the umbrella assembly 20 is not in use, such that the rod 16 rests flush against the upper surface 17. In this way, the device takes up less space providing increased storage and transport capabilities. Similarly, in the illustrated embodiment of FIG. 3B, the rod 16 is telescopically extendable along a longitudinal axis thereof, such that the rod 16 can collapse to occupy less space for storage and transport. In such embodiments, the extendable arm 19 can be affixed to a singular telescopic segment of the rod 16, such that the remaining telescopic segments are not impeded in operation by the points of contact between the extendable arm 19 and the rod 16.

In the illustrated embodiment of FIG. 3B, the fastener 13 comprises a cylindrical channel 33 defined between a pair of clamp members 34, wherein the fastener 13 is configured to secure about a cylindrical support, such as the handlebar of a wheelchair, stroller, bicycle, or the like. The fastener 13 is configured to frictionally engage the cylindrical support, such that the housing 12 is secured thereto. In some embodiments, the fastener 13 comprises a high friction material, such as rubber, to increase frictional engagement with the cylindrical support. In the shown embodiment, the pair of clamp members 34 are biased towards the cylindrical channel 33, such that when the cylindrical support is inserted through an opening defined between the pair of clamp members 34, the pair of clamp members 34 close about the cylindrical support to secure the housing 12 thereto.

Referring now to FIG. 4, there is shown a perspective view of an embodiment of the electronic umbrella in use. In one use, the housing 12 can be removably secured to the handle 38 of a stroller or other device 36. The user can then elevate the rod 16 in embodiments having either a hingedly connected rod 16 or a telescopic rod 16. Once properly positioned, the user can operate the plurality of controls to extend the extendable arm to a desired distance to ensure that the umbrella assembly 20 is positioned over an individual 37. Once extended to a desired length, the umbrella assembly 20 can further be positioned as desired via the pivot connection between the umbrella assembly 20 and the distal end of the extendable arm. Furthermore, in some embodiments, the rod 16 can be rotated about a longitudinal axis thereof to position the umbrella assembly 20 as desired. In this manner, the user can operate a stroller or other device 36 while ensuring that the umbrella assembly 20 provide protection against inclement weather or harsh sunlight.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly, and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An electronic umbrella, comprising:

a housing having a fastener disposed on a lower surface thereof;

a motor disposed within the housing, wherein the motor is operably connected to a power source disposed within the housing;

a rod extending from an upper surface of the housing;

an extendable arm affixed to the rod, wherein the extendable arm is operably connected to the motor;

wherein the extendable arm comprises a plurality of hingedly connected segments;

whereupon actuation of the motor, the extendable arm selectively moves between an extended position and a retracted position;

an umbrella assembly comprising a central support, a plurality of ribs extending from the central support, and a canopy affixed over the plurality of ribs;

wherein the central support is pivotally affixed to a distal end of the extendable arm.

2. The electronic umbrella of claim 1, further comprising a pair of controls disposed on the housing, wherein a first control of the pair of controls actuates the motor to extend the extendable arm, and a second control of the pair of controls actuates the motor to retract the extendable arm.

3. The electronic umbrella of claim 1, wherein the rod is rotatably affixed to the upper surface.

4. The electronic umbrella of claim 1, wherein the extendable arm comprises a scissor arm.

5. The electronic umbrella of claim 4, wherein the scissor arm comprises a first arm member having a first plurality of hingedly connected segments disposed opposite a second arm member having a second plurality of hingedly connected segments.

6. The electronic umbrella of claim 1, wherein the fastener comprises a clamp defining a cylindrical channel between a pair of clamp members.

7. The electronic umbrella of claim 1, wherein the central support is pivotally affixed to the distal end via a ball and socket joint.

8. The electronic umbrella of claim 1, wherein the rod is telescopically adjustable in length.

9. The electronic umbrella of claim 1, wherein the distal end of the extendable arm is disposed parallel to the rod in each of the extended and retracted positions.

10. An electronic umbrella, comprising:

a housing having a fastener disposed on a lower surface thereof;

a motor disposed within the housing, wherein the motor is operably connected to a power source disposed within the housing;

a rod extending from an upper surface of the housing;

wherein the rod is hingedly affixed to the upper surface, such that the rod can be collapsed to rest flush against the upper surface;

an extendable arm affixed to the rod, wherein the extendable arm is operably connected to the motor;

whereupon actuation of the motor, the extendable arm selectively moves between an extended position and a retracted position;

an umbrella assembly comprising a central support, a plurality of ribs extending from the central support, and a canopy affixed over the plurality of ribs;

wherein the central support is pivotally affixed to a distal end of the extendable arm.

11. The electronic umbrella of claim 10, further comprising a pair of controls disposed on the housing, wherein a first control of the pair of controls actuates the motor to extend the extendable arm, and a second control of the pair of controls actuates the motor to retract the extendable arm.

12. The electronic umbrella of claim 10, wherein the rod is rotatably affixed to the upper surface.

13. The electronic umbrella of claim 10, wherein the extendable arm comprises a plurality of hingedly connected segments.

14. The electronic umbrella of claim 10, wherein the extendable arm comprises a scissor arm.

15. The electronic umbrella of claim 14, wherein the scissor arm comprises a first arm member having a first plurality of hingedly connected segments disposed opposite a second arm member having a second plurality of hingedly connected segments.

16. The electronic umbrella of claim 10, wherein the fastener comprises a clamp defining a cylindrical channel between a pair of clamp members.

17. The electronic umbrella of claim 10, wherein the central support is pivotally affixed to the distal end via a ball and socket joint.

18. The electronic umbrella of claim 10, wherein the rod is telescopically adjustable in length.

19. The electronic umbrella of claim 10, wherein the distal end of the extendable arm is disposed parallel to the rod in each of the extended and retracted positions.

20. An electronic umbrella, comprising:

a housing having a fastener disposed on a lower surface thereof;

a motor disposed within the housing, wherein the motor is operably connected to a power source disposed within the housing;

a rod extending from an upper surface of the housing;

an extendable arm affixed to the rod, wherein the extendable arm is operably connected to the motor;

whereupon actuation of the motor, the extendable arm selectively moves between an extended position and a retracted position;

an umbrella assembly comprising a central support, a plurality of ribs extending from the central support, and a canopy affixed over the plurality of ribs;

wherein the central support is pivotally affixed to a distal end of the extendable arm via a ball and socket joint.

* * * * *